United States Patent [19]

Taylor

[11] Patent Number: 5,072,904

[45] Date of Patent: Dec. 17, 1991

[54] ARTISTS' BRUSH HOLDER

[76] Inventor: Kevin D. Taylor, 1716 N. 1900 West, Ogden, Utah 84404

[21] Appl. No.: 509,489

[22] Filed: Apr. 16, 1990

[51] Int. Cl.[5] ..... A46B 17/00

[52] U.S. Cl. ..... 248/110; 211/65; 211/89; 248/207

[58] Field of Search ..... 248/110, 111, 284, 207; 211/65, 89

[56] References Cited

U.S. PATENT DOCUMENTS

| | | | |
|---|---|---|---|
| 604,008 | 5/1898 | Hughes | 248/284 X |
| 2,015,628 | 9/1935 | Kanai | 248/207 |
| 3,063,569 | 11/1962 | Huber | 248/110 X |
| 4,597,496 | 7/1986 | Kaplan | 211/89 X |

FOREIGN PATENT DOCUMENTS

| | | | |
|---|---|---|---|
| 675340 | 1/1966 | Belgium | 211/89 |
| 356393 | 7/1922 | Fed. Rep. of Germany | 211/65 |
| 612854 | 4/1935 | Fed. Rep. of Germany | 211/89 |

*Primary Examiner*—David L. Talbott
*Attorney, Agent, or Firm*—A. Ray Osburn

[57] ABSTRACT

A device for holding artists' brushes and the like having two pairs of opposed rows of reeds with their tips in close proximity, the reeds deflecting to support the handle of the brush at spaced apart points. The device permits the brushes to be stored horizontally to prevent draining of wet paint onto the handles, or in other attitudes that may be preferred by the user.

18 Claims, 5 Drawing Sheets

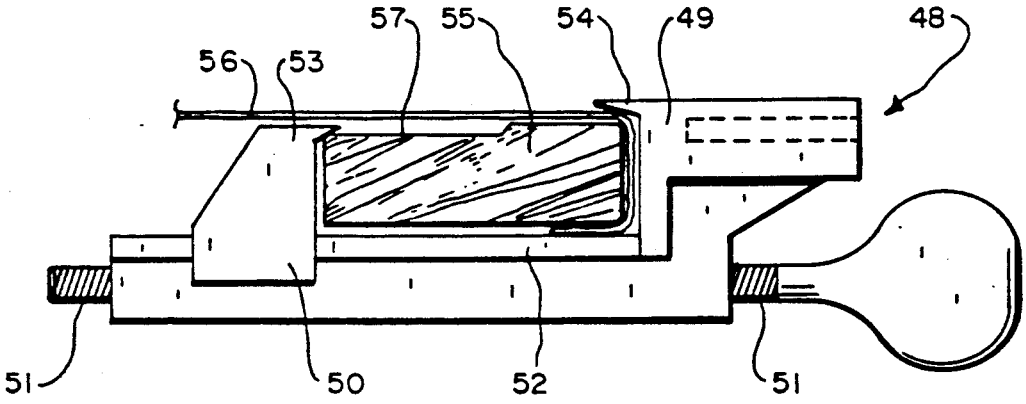
FIG. 8
FIG. 9
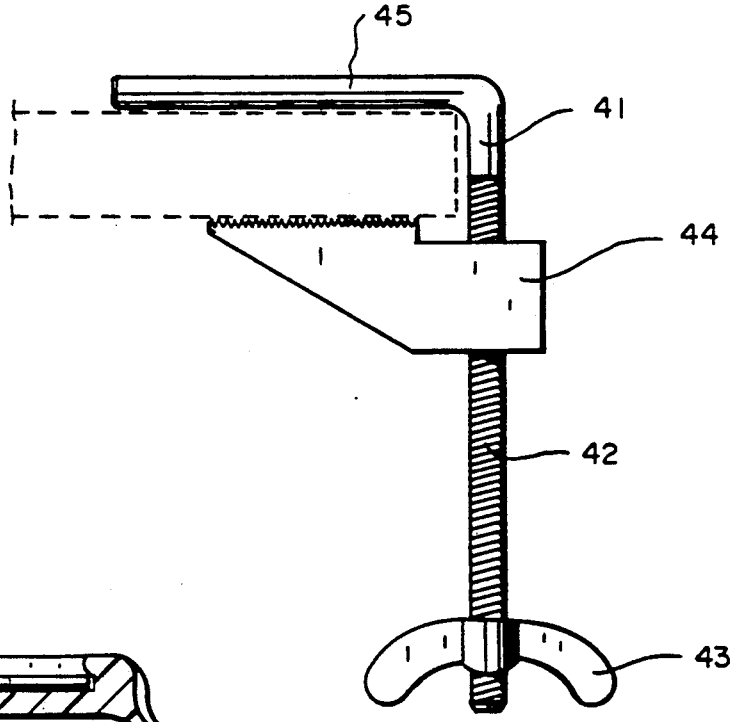
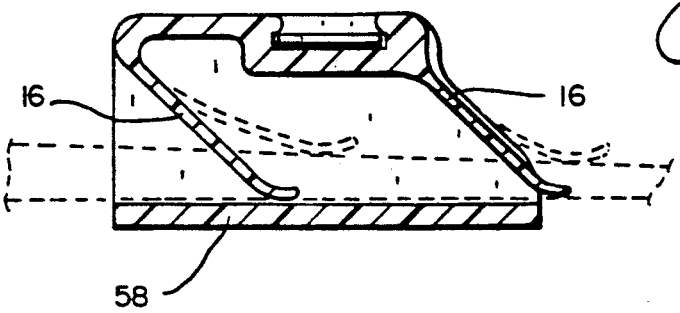
FIG. 12

ARTISTS' BRUSH HOLDER

BACKGROUND OF THE INVENTION

1. Field

The field of the invention is devices for work place storage of pencils, pens and the like and more particularly such devices for artists' brushes.

2. State of the Art

The management of manual writing, drafting and painting instruments to avoid clutter and disorganization at the place of work has prompted the design of many temporary storage devices. Simple cup containers are often used, resting upon the desk top or other working surface. Many devices provide individual slots or the like for organized storage of numerous instruments. Examples are U.S. Pat. No. 3,532,222, which is adapted for vertical storage of paint brushes in spaced apart wells. U.S. Pat. No. 3,981,399 provides for the tip downward storage of house-painting brushes, and 3,471,032 provides a conical cup container for generally vertical storage. The present devices do not anticipate the desirability of storing instruments horizontally rather than vertically as may be advantagous to avoid fouling of the handle portion by downward draining of excess ink or paint. The coiled spring devices, revealed for example in U.S. Pat. Nos. 954,651, 2,518,401 and Des. 270,845 permit approximately horizontal storage, but neither positively place nor firmly retain the instruments in that position. Nor do the structures of these devices permit storage of the instruments in selective vertical to horizontal positions. Clearly, a need exists for a pencil or brush holder wherein the storage attitude of the brush may be easily and reliably selected and maintained.

BRIEF SUMMARY OF THE INVENTION

With the foregoing in mind, the present invention eliminates or substantially alleviates the shortcomings and disadvantages in prior art artist brush holders The inventive brush holder unit comprises a three dimensional frame from the front and rear of which is cantilevered a pair of opposing rows of reeds parallel, projecting inwardly from the top and bottom of the frame with the free ends of the reeds of the rows in close proximity to each other. The reeds are preferably thin and flat and arranged side by side in each row, with each row angled inwardly and rearwardly to the frame The end of the brush handle is thrust into and through the frame from front to rear, guided by the vees of the converging reeds, deflecting a pair of front reeds and a corresponding pair of rear reeds. The spaced apart front and rear reed pairs provide spaced apart gripping support to the handle, holding it in predictable position reliably with respect to the frame. The free end of each reed is preferably curved rearwardly of the frame to assure free withdrawal of the brush handle forwardly out of the frame.

Preferably, the invention includes an adjustable support for selective positioning of the frame, so that the stored brushes may be stored selectively in horizontal, vertical, or tilted positions. According to other facets of the invention, the frame may be supported upon the top or edge of a desk or drafting board, or upon the edge of a painter's canvas stretch frame.

The principal object of the invention is therefore the provision of an improved holder allowing artist brushes to be stored easily and reliably in selective positions.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
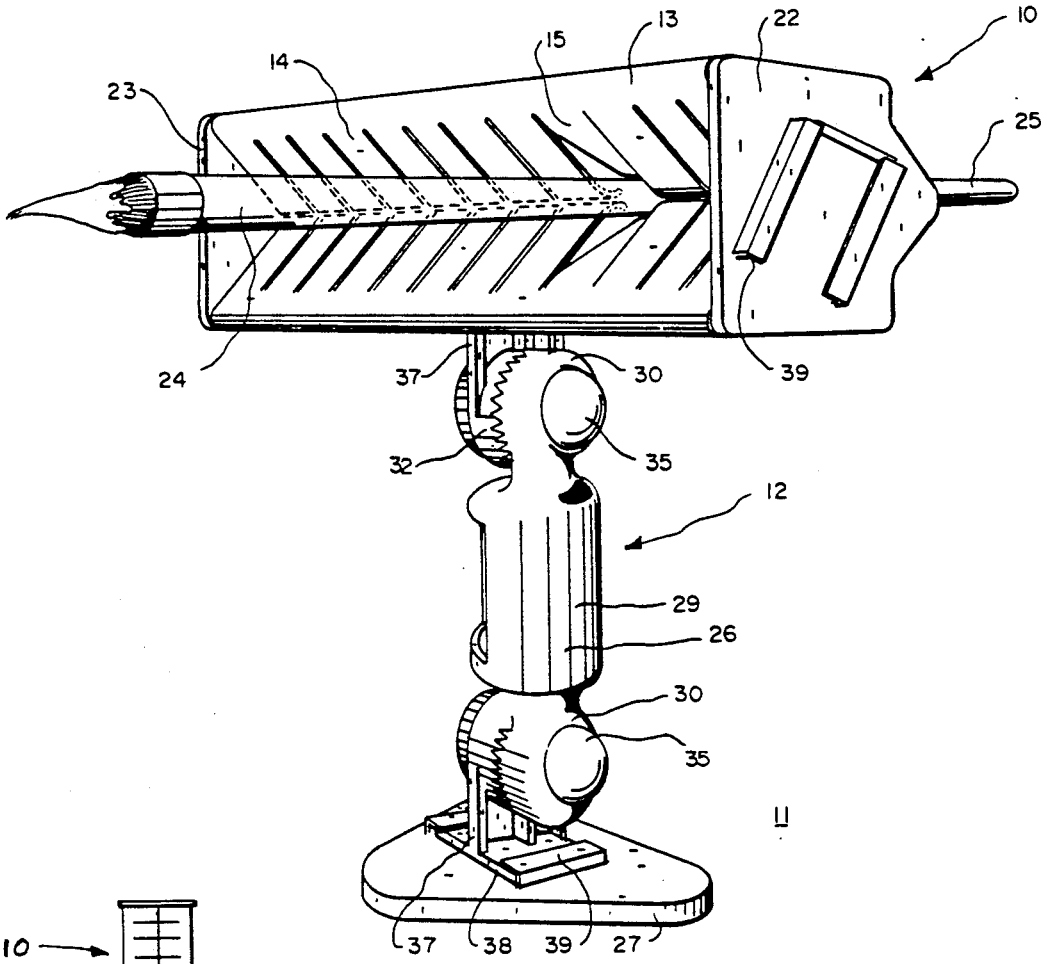
FIG. 1 is a right front perspective of an artist's brush holder according to the invention illustrated installed upon a desk top, drawn to substantially full scale, FIG. 2 a front elevation view of the brush holder of FIG. 1, drawn to the same scale, FIG. 3 a top plan view of the brush holder of FIG. 2, drawn to the same scale, FIG. 4 a sectional view of the support base, taken along line 4—4 of FIG. 1, drawn to the same scale, FIG. 5 a bottom plan view of the base of FIG. 4, drawn to the same scale, FIG. 6 a vertical sectional view of a fragment of the brush holder of FIG. 2, taken along line 6—6 thereof, drawn to the same scale, FIG. 7 a horizontal cross sectional view taken along line 7—7 of FIG. 2, drawn to the same scale, FIG. 8 a side elevation view of a brush holder base adapted for use upon an artist's canvas stretch frame, drawn to substantially full scale, FIG. 9 a side elevation view of a clamping device to be used with a desk top base, drawn to substantially full scale, FIG. 10 a view of a brush holder in accordance with the invention with the brush holding unit thereof mounted in various positions, drawn to a reduced scale, FIG. 11 a perspective view of an embodiment of a brush holder in accordance with the invention, having comb tooth-like reeds, drawn to a reduced scale, and FIG. 12 a vertical sectional view of another embodiment of a brush holder in accordance with the invention, drawn to substantially full scale.
Figure 2:
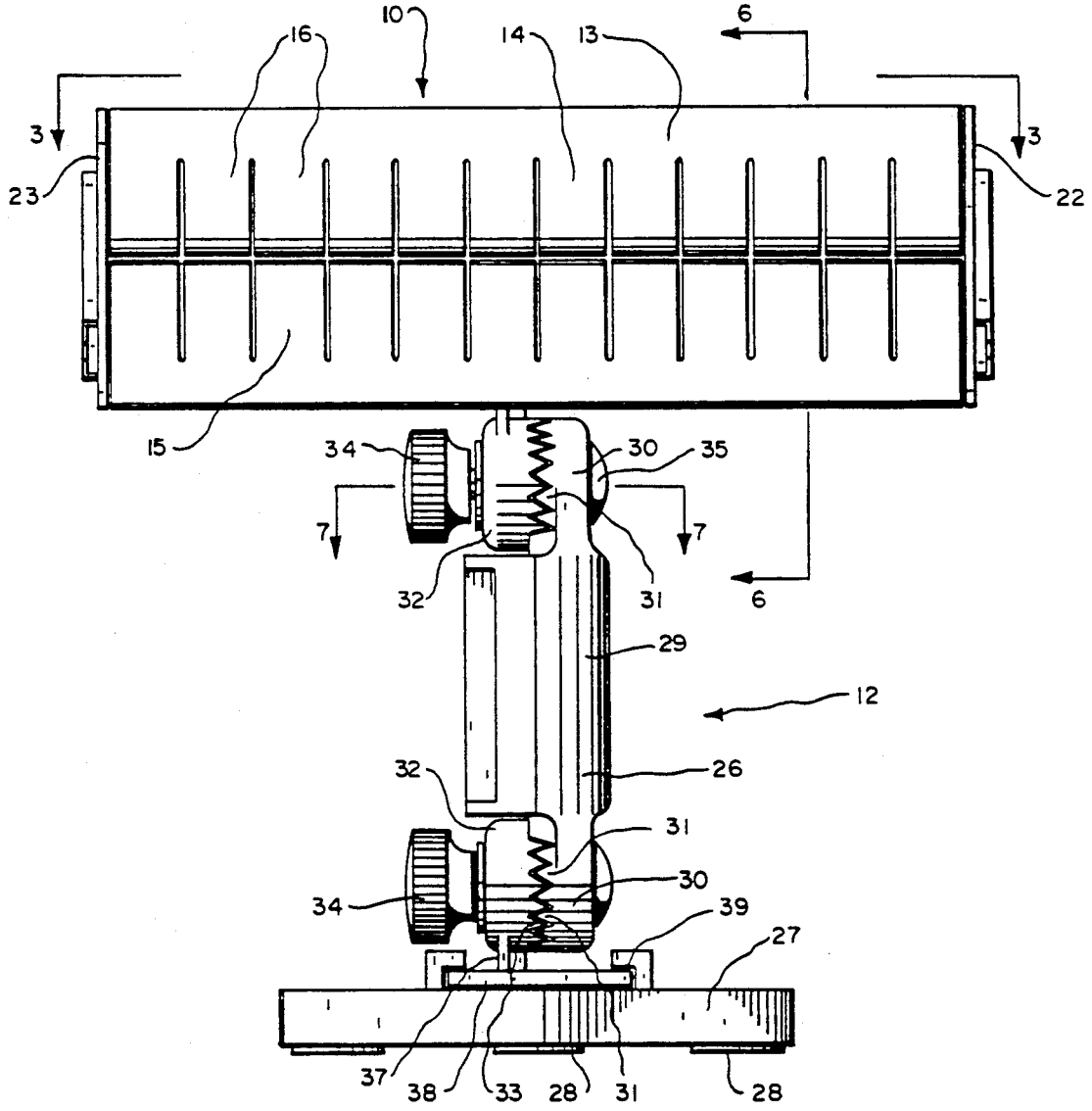
Figure 3:
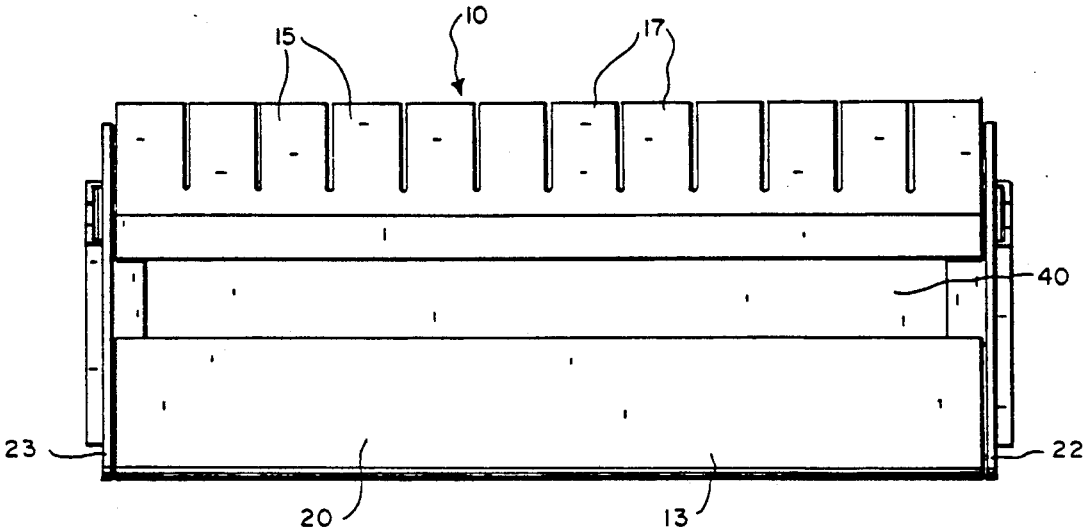
Figure 4:
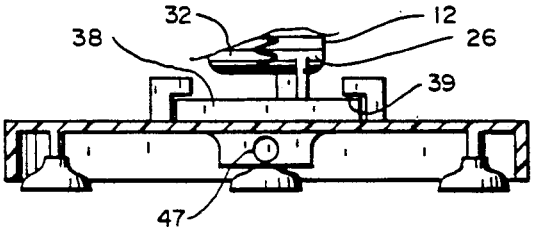
Figure 5:
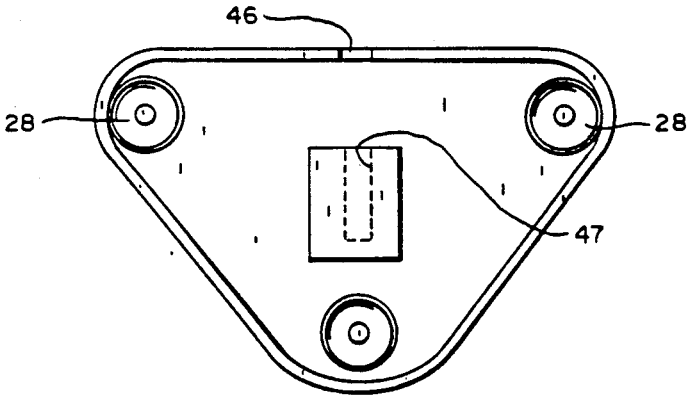

An artist's brush holder unit 10 in accordance with the invention is shown mounted upon the top surface 11 of a desk or the like by a suitable support structure 12. (FIGS. 1-3)

Figure 6:
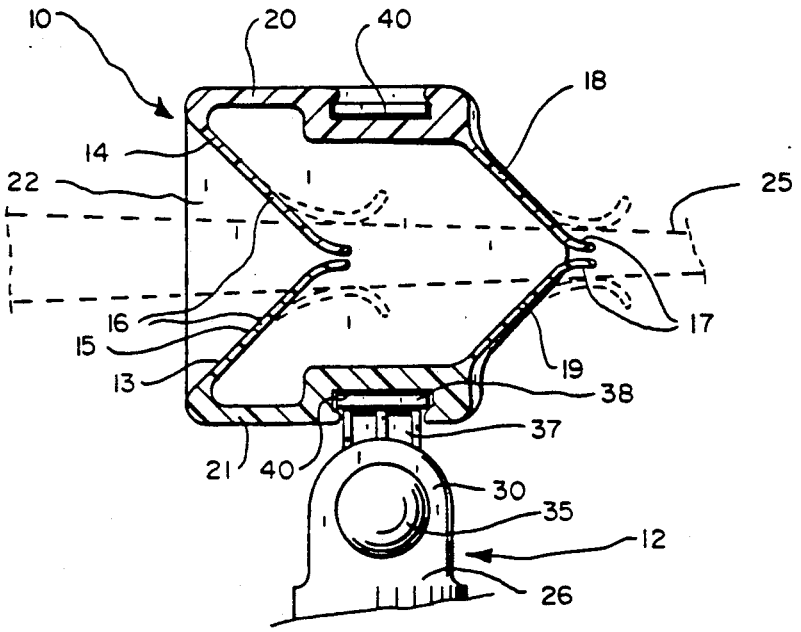
Figure 7:
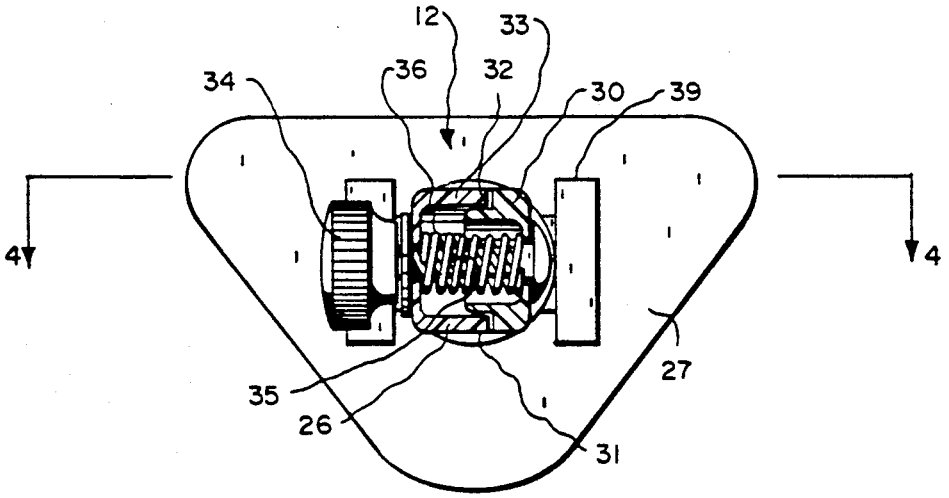

At its front side 13, holder unit 10 has upper and lower assemblies 14 and 15 respectively, of thin, flexible, flat reeds 16, arranged side by side in rows and angled rearwardly and inwardly so that curved tips 17 of the two rows are in close proximity with each other. (FIG. 6) Another pair of opposed, angled reed assemblies 18 and 19 is provided at the rear of unit 10. Top front and rear reed assemblies 14 and 18 are integrally formed with a top plate member 20, while assemblies 16 and 19 are formed integrally with a bottom plate member 21. Plate member 20 and 21 are secured together through a pair of end walls 22 and 23. The upper and lower reed assemblies provide at both front and rear of unit 10 a series of pairs of aligned opposing reeds 16. The front pairs are themselves aligned with corresponding pairs at the rear of unit 10.

Opposing paired reeds 16 deflect in response to brush handle 24 as it is thrust between the pair of tips 17, having been guided thereto by the converging reeds 16, first at the front and then at the rear of unit 10. The end 25 of brush handle 24 tends to be deflected laterally by the sides of the reeds 15 of neighboring pairs, sliding easily across the smoothed curved tips, so that only one pair of reeds are deflected to hold the brush in stored position. However, adjacent pairs of reeds are also deflected to accommodate oversized brush handles.

To be readily at hand, brush holder 10 is preferably elevated somewhat above desk top surface 11, as by post assembly 26 secured to reach upwardly from a desk top base 27. (FIGS. 1–3, 4, 5 and 7) Base 27 is anchored to desk surface 11, as by suction cups 28. Post 26 comprises an elongate body 29 carrying at each of its ends an integral connecting knob 30 with a vertical serrated rim 31. Arranged to engage each serrated rim 31 is one of a pair of end cups 32, each also having a serrated rim 33, secured in selective rotated position by a knurled locking nut 34 acting on a carriage bolt 35. A compression spring 36 installed around bolt 35 assures immediate automatic disengagement of the serrations when nut 34 is loosened. End cups 32 each have a projecting portion 37 terminating in a bayonet tab 38. Lower bayonet tab 38 engages a matching bayonet slot 39 on the top of base 27. Upper bayonet tab 38 selectively engages one of a pair of matching bayonet slots 39 on the end walls 22 of unit 10, or one of the elongate slots 40 on top and bottom plate members 20 or 21. Slots 40 are not open ended, each being configured for snap-in of a tab 38 snugly into any selected location therealong.

Figure 10:
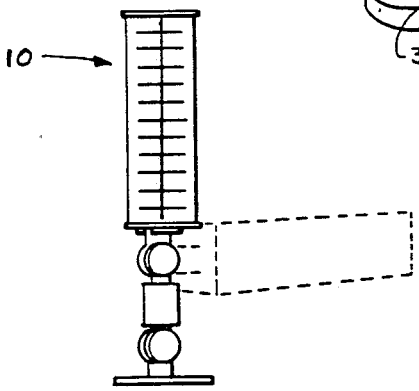

Through selective rotational positioning of cups 23 upon end knobs 30, holder unit 10 may be tilted into and secured in selected horizontal or vertical positions for holding of the brushes. By selective use of end or side bayonet slots, unit 10 may be held centrally or cantilevered from either of its ends from post 26. (FIG. 10)

Desk base 27 may further include an L-shaped member 41 with a threaded leg 42 carrying a wing nut 43 and a jaw member 44, so that units 10 not having suctions cups 28 may be clamped to an edge of the desk top. (FIG. 9) Unthreaded leg 45 is inserted into bores 46 and 47 provided in base 27.

A unit 10 base 48 for use with a painter's canvas frame is illustrated in FIG. 8. Body 49 carries a sliding block 50 urged by a threaded rod 51 to move along rails 52 on body 49. Block 50 has a short overhanging lip 53, whereas body 49 carries an oppositely directed lip 54. Body lip 54 engages frame 55 over canvas 56, while block lip 53 engages frame 55 below canvas 56. A bayonet slot 39 is engaged by the bayonet tab 38 on end cup 32 at the end of post 26. With this mounting device, canvas 56 can be utilized for painting very near to its edge above shallow cutaway 57 provided in frame 55.

Figure 11:
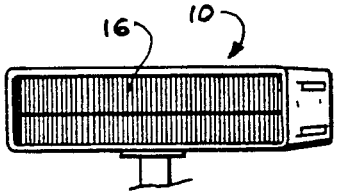

Another embodiment of brush holder unit 10, although not preferred, is illustrated in FIG. 11. In this embodiment, the reeds 16, now in the form of comb teeth, all extend perpendicularly across unit 10. (FIG. 11) The teeth 16 deflect generally in a plane perpendicular to brush handle 24, which causes them to tend to hang up upon surface irregularities on the brush handles.

Another, also not preferred, embodiment comprises front and rear rows of reeds 15 cantilevered only from the top, for example, of unit 10, the handle being held against the bottom member 58 by the reeds 16. (FIG. 12)

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A holder for artist paint brushes comprising:

a three dimensional support frame having a front, rear, right side, left side, bottom and top, the front and rear being spaced substantially apart;

a row of equal length, parallel, flexible reeds cantilevered from the top of the frame at its front;

a row of equal length, parallel, flexible reeds cantilevered from the bottom of the frame at its front, the free ends of the reeds of the two front rows being juxtaposed;

a row of equal length, parallel, flexible reeds cantilevered from the top of the frame at its rear;

a row of equal length, parallel, flexible reeds cantilevered from the bottom of the frame at its rear, the free ends of the reeds of the two rear rows being juxtaposed, the four rows being mutually parallel; and means supporting the frame upon a desk or the like; wherein the reeds are thin and flat laterally to the frame; and the free end of each reed is substantially curved rearwardly of the frame.

2. The brush holder of claim 1, wherein:

each reed of each row is directly aligned with a corresponding reed in each of the other rows.

3. The brush holder of claim 1, wherein:

each reed of each row is directly aligned with a corresponding reed in each of the other rows.

4. The brush holder of claim 1, wherein:

the frame anchoring means permits support of the frame with the rows of reeds selectively positioned from vertical to horizontal, and with the frame tilted from front to rear from substantially upward to substantially downward.

5. The brush holder of claim 4, wherein the frame anchoring means comprises:

a base adapted to be secured to the desk or the like;

an elongate post having an uppermost end and a lowermost end;

an upper and a lower structure securing the respective post ends to the frame and the base, with the lowermost end of the post in selectively rotated position with respect to the base about a lower horizontal axis and the frame in selectively rotated position with respect to the uppermost end of the post about an upper horizontal axis parallel to said lower axis.

6. The brush holder of claim 5, wherein the post end securing structures each comprise:

a knob integral with an end of the post, having a circular, vertical serrated rim;

a cup having a matching serrated rim;

bolt and nut means securing the serrated rims releasably together in selective relative rotated positions; and means for releasably securing the cup selectively to the base and the frame.

7. The brush holder of claim 6, further comprising:

spring means urging the knob and the cup into separated positions.

8. The brush holder of claim 6, wherein the means securing the cup to the base and the frame comprises:

a bayonet tab carried by each cup; and at least one bayonet slot carried by each of the base and by the frame.

9. The brush holder of claim 8, wherein:

the base is secured to the desk or the like by detachable suction cups.

10. The brush holder of claim 8, wherein:

the base is secured to the desk or the like at its edge by a detachable clamp.

11. The brush holder of claim 8, wherein the base is adapted for use with a stretch frame with attached canvas, the base comprising:

a body with an inwardly facing surface bearing upon the outside edge of the frame and the canvas thereon;

a block slideably associated with the body, having an outwardly facing surface bearing upon the inside edge of the frame and dimensioned to avoid contact with the stretched canvas; and threaded rod and bore means for releasably clamping the body and the block about the edge of the stretch frame.

12. The brush holder of claim 11, wherein:

the block carries a thin lip extending outwardly of the frame between the inside edge of the frame and the stretched canvas.

13. The brush holder of claim 1, wherein:

the reeds are in cross section proportioned to have comparable dimensions laterally and longitudinally to the frame, so as to be comparable flexible in said directions.

14. The brush holder of claim 13, wherein:

the reeds are in cross section proportioned to be elongate longitudinally to the frame, so as to be more flexible laterally than longitudinally thereto.

15. A holder for artist paint brushes and the like, comprising:

a three dimensional support frame having a front, a rear two sides, a top and a bottom, the latter having an inner, upwardly facing surface generally free of abrupt discontinuities, the front and rear being spaced substantially apart;

a row of equal length, parallel, flexible reeds cantilevered from the top of the frame at its front;

a row of equal length, parallel, flexible reeds cantilevered from the top of the frame at its rear; wherein the free ends of the reeds and the upwardly facing surface of the frame bottom are juxtaposed.

16. The brush holder of claim 15, wherein:

the reeds are angled inwardly and rearwardly of the frame.

17. A holder for artist paint brushes comprising:

a three dimensional support frame having a front, rear, right side, left side, bottom and top, the front and rear being spaced substantially apart;

a row of equal length, parallel, flexible reeds cantilevered from the top of the frame at its front;

a row of equal length, parallel, flexible reeds cantilevered from the bottom of the frame at its front, the free ends of the reeds of the two front rows being juxtaposed;

a row of equal length, parallel, flexible reeds cantilevered from the top of the frame at its rear;

a row of equal length, parallel, flexible reeds cantilevered from the bottom of the frame at its rear, the free ends of the reeds of the two rear rows being juxtaposed, the four rows being mutually parallel; and means supporting the frame upon a desk or the like; wherein the front and rear reeds are angled inwardly and rearwardly with respect to the frame; and the free ends of each reed is substantially curved rearwardly of the frame.

18. The brush holder of claim 17, wherein:

the frame anchoring means permits support of the frame with the rows of reeds selectively positioned from vertical to horizontal, and with the frame tilted from front to rear from substantially upward to substantially downward.

* * * * *